US012426629B2

(12) United States Patent
Lee et al.

(10) Patent No.: US 12,426,629 B2
(45) Date of Patent: Sep. 30, 2025

(54) AEROSOL DELIVERING DEVICE AND AEROSOL GENERATING DEVICE WITH THE SAME

(71) Applicant: KT&G CORPORATION, Daejeon (KR)

(72) Inventors: Jong Sub Lee, Gyeonggi-do (KR); Ju Hwan Lee, Gyeongsangbuk-do (KR)

(73) Assignee: KT&G CORPORATION, Daejeon (KR)

( * ) Notice: Subject to any disclaimer, the term of this patent is extended or adjusted under 35 U.S.C. 154(b) by 681 days.

(21) Appl. No.: 17/421,174

(22) PCT Filed: Dec. 14, 2020

(86) PCT No.: PCT/KR2020/018255
§ 371 (c)(1),
(2) Date: Jul. 7, 2021

(87) PCT Pub. No.: WO2021/157847
PCT Pub. Date: Aug. 12, 2021

(65) Prior Publication Data

US 2023/0000151 A1 Jan. 5, 2023

(30) Foreign Application Priority Data

Feb. 6, 2020 (KR) ..... 10-2020-0014349

(51) Int. Cl.
*A24F 40/30* (2020.01)
*A24F 7/00* (2006.01)
(Continued)

(52) U.S. Cl.
CPC ..... *A24F 40/30* (2020.01); *A24F 7/00* (2013.01); *A24F 40/10* (2020.01); *A24F 40/20* (2020.01);
(Continued)

(58) Field of Classification Search
None
See application file for complete search history.

(56) References Cited

U.S. PATENT DOCUMENTS 9,198,460 B2 12/2015 Tritz et al.
9,861,136 B2 1/2018 Li et al.
(Continued)

FOREIGN PATENT DOCUMENTS

CN 103271449 A 9/2013
CN 106231929 A 12/2016
(Continued)

OTHER PUBLICATIONS

JP2004159675A, Perfume Suction Pipe, (Year: 2004).*
(Continued)

*Primary Examiner* — Melvin C. Mayes
(74) *Attorney, Agent, or Firm* — Sughrue Mion, PLLC

(57) ABSTRACT

An aerosol delivering device includes a case that is configured to accommodate an aerosol generating source and includes a discharge hole that is configured to discharge an aerosol generated by the aerosol generating source; a rotation body that is configured to rotate with respect to the case and includes a plurality of chambers sequentially arranged in a rotation direction, each of the plurality of chambers accommodating a medium and configured to pass the aerosol therethrough; and a position limiter that is configured to maintain a rotational position of the rotation body with respect to the case so that a position of at least one of the plurality of chambers corresponds to a position of the discharge hole.

15 Claims, 12 Drawing Sheets

(51) Int. Cl.

| | |
|---|---|
| ***A24F 40/10*** | (2020.01) |
| ***A24F 40/20*** | (2020.01) |
| ***A24F 40/42*** | (2020.01) |
| ***A24F 40/485*** | (2020.01) |
| ***A24F 40/60*** | (2020.01) |

(52) U.S. Cl.
CPC ..... *A24F 40/42* (2020.01); *A24F 40/485* (2020.01); *A24F 40/60* (2020.01)

(56) References Cited

U.S. PATENT DOCUMENTS

| | | | | |
|---|---|---|---|---|
| 10,206,435 | B2 | 2/2019 | Rogan et al. | |
| 11,019,847 | B2 | 6/2021 | Watson et al. | |
| 2015/0122276 | A1* | 5/2015 | Johnson | A24D 3/04 131/331 |
| 2015/0335070 | A1 | 11/2015 | Sears et al. | |
| 2016/0095356 | A1 | 4/2016 | Chan | |
| 2016/0157525 | A1 | 6/2016 | Tucker et al. | |
| 2016/0235121 | A1* | 8/2016 | Rogan | H05B 1/0227 |
| 2018/0338542 | A1 | 11/2018 | Rogan et al. | |
| 2019/0200673 | A1* | 7/2019 | Bless | A24F 40/485 |
| 2019/0223497 | A1 | 7/2019 | Lai | |
| 2019/0289909 | A1* | 9/2019 | Hejazi | A61M 11/042 |
| 2019/0307168 | A1 | 10/2019 | Zhao et al. | |
| 2019/0307173 | A1 | 10/2019 | Qiu | |
| 2019/0328044 | A1 | 10/2019 | Qiu | |
| 2019/0373951 | A1 | 12/2019 | Wu et al. | |
| 2021/0321673 | A1 | 10/2021 | Zhao et al. | |
| 2022/0354169 | A1* | 11/2022 | Cho | A24F 40/40 |
| 2022/0369703 | A1* | 11/2022 | Kim | A24F 40/40 |
| 2023/0134145 | A1* | 5/2023 | Park | G01B 7/30 131/329 |
| 2023/0143680 | A1* | 5/2023 | Lee | A24F 40/50 131/329 |
| 2023/0189882 | A1* | 6/2023 | Lee | A24F 40/20 131/329 |
| 2023/0354890 | A1* | 11/2023 | Lee | A24F 40/10 |

FOREIGN PATENT DOCUMENTS

| | | | | |
|---|---|---|---|---|
| CN | 110279147 | A | | 9/2019 |
| EP | 2 989 912 | A1 | | 3/2016 |
| JP | 52-49792 | U | | 4/1977 |
| JP | 2004159675 | A | * | 6/2004 |
| JP | 2016-535982 | A | | 11/2016 |
| JP | 2017-515493 | A | | 6/2017 |
| KR | 10-1936979 | B1 | | 1/2019 |
| KR | 10-2019-0042014 | A | | 4/2019 |
| RU | 2635970 | C2 | | 11/2017 |
| RU | 2655290 | C1 | | 5/2018 |
| WO | 2015/052192 | A1 | | 4/2015 |

OTHER PUBLICATIONS

International Search Report for PCT/KR2020/018255 dated Mar. 22, 2021 (PCT/ISA/10).
Written Opinion of the International Searching Authority for PCT/KR2020/018255 dated Mar. 22, 2021 (PCT/ISA/237).
Extended European Search Report dated Jan. 12, 2022, issued by the European Patent Office in application No. 20908443.3.
Japanese Office Action dated Nov. 1, 2022 in Japanese Application No. 2021-552963.
Office Action dated Mar. 17, 2023, issued in Russian Application No. 2021123765/03.
Office Action dated Apr. 11, 2023, issued in Chinese Application No. 202080014514.6.

* cited by examiner

AEROSOL DELIVERING DEVICE AND AEROSOL GENERATING DEVICE WITH THE SAME

CROSS REFERENCE TO RELATED APPLICATIONS

This application is a National Stage of International Application No. PCT/KR2020/018255 filed Dec. 6, 2020, claiming priority based on Korean Patent Application No. 10-2020-0014349 filed Feb. 6, 2020.

TECHNICAL FIELD

Embodiments of the present disclosure relate to an aerosol delivering device and an aerosol generating device including the same, and more particularly, to an aerosol delivering device that is convenient to carry and use because chambers including a medium rotate, and an aerosol generating device including the same.

BACKGROUND ART

Recently, there is increasing demand for a substitute method for overcoming disadvantages of a general aerosol providing method by combusting a cigarette. For example, studies on a method of providing an aerosol by heating an aerosol generating material in a liquid or solid state, or generating an aerosol by heating an aerosol generating material and then passing the generated aerosol through an aroma medium has been conducted.

An aerosol delivering device that delivers an aerosol having a flavor by using both a liquid aerosol generating material and a solid aroma medium includes a liquid cartridge containing a liquid aerosol generating material and a flavor cartridge for giving flavor to vapor.

DISCLOSURE OF INVENTION

Technical Problem

When using an aerosol delivering device, a plurality of flavor cartridges are generally consumed while one liquid cartridge is used. For example, if one liquid cartridge may generate an aerosol corresponding to a pack of cigarettes in general, three to four flavor cartridges have to be replaced while one liquid cartridge is used. Accordingly, it is inconvenient for a user of an aerosol delivering device to carry and use the aerosol delivering device because the user of the aerosol delivering device has to carry a separate flavor cartridge and replace the flavor cartridge which is used up.

Solution to Problem

Embodiments of the present disclosure provide an aerosol delivering device that is convenient to use and carry, and an aerosol generating system including the same.

According to one or more embodiments, an aerosol delivering device is provided. The aerosol delivering device includes: a case that is configured to accommodate an aerosol generating source and includes a discharge hole that is configured to discharge an aerosol generated by the aerosol generating source; a rotation body that is configured to rotate with respect to the case, includes a plurality of chambers sequentially arranged in a rotation direction, each of the plurality of chambers accommodating a medium and configured to pass the aerosol therethrough; and a position limiter that is configured to maintain a rotational position of the rotation body with respect to the case so that a position of at least one of the plurality of chambers corresponds to a position of the discharge hole.

According to an embodiment, the position limiter includes a protrusion supported by one from among the rotation body and the case, and a plurality of grooves arranged in the other from among the rotation body and the case, the plurality of grooves configured to couple to the protrusion to maintain the rotational position of the rotation body.

According to an embodiment, the other from among the rotation body and the case further includes a cam surface formed between the plurality of grooves, the cam surface configured to guide a movement of the protrusion.

According to an embodiment, the position limiter further includes a spring that is arranged between the rotation body and the case and is configured to be pressed between the rotation body and the case while the rotation body rotates such as to be deformed elastically, wherein the protrusion is a part of the spring.

According to an embodiment, the spring has an arc shape, and the aerosol delivering device further includes: an end support portion that is configured to support an end portion of the spring, and an outer support portion that is configured to support at least a part of an outer side of the spring.

According to an embodiment, the aerosol delivering device further includes a rotation shaft that is connected to the case and rotatably supports the rotation body.

According to an embodiment, the rotation body further includes: a mouthpiece that includes an outlet configured to discharge the aerosol passing through the medium accommodated in the plurality of chambers to the outside, and an upper plate that covers end portions of the plurality of chambers facing the outlet, and includes an upper through hole through which the aerosol is configured to pass.

According to an embodiment, the aerosol delivering device further includes a sealing ring arranged between the mouthpiece and an edge of the upper plate.

According to an embodiment, the rotation body further comprises a lower through hole that is configured to transfer the aerosol delivered from the discharge hole to at least one of the plurality of chambers.

According to an embodiment, the aerosol delivering device further includes a transfer chamber that is arranged between the rotation body and the case, surrounds the discharge hole, and is configured to transfer the aerosol discharged from the discharge hole to at least one of the plurality of chambers.

According to an embodiment, the aerosol delivering device further includes a rotation guide arranged between the case and the rotation body and configured to guide a rotation operation of the rotation body, wherein the case and the rotation body have a cylindrical shape.

According to an embodiment, the medium of each of the plurality of chambers of the rotation body are different types from each other.

According to an embodiment, the rotation body further comprises a plurality of marks that indicate the types of the medium included in the plurality of chambers and are arranged to correspond to each of the plurality of chambers.

According to an embodiment, the aerosol delivering device further includes a signal generator that is arranged between the rotation body and the case and is configured to indicate a type of the medium of one of the plurality of chambers through which the aerosol passes among the plurality of chambers according to the rotational position of the rotation body.

According to an embodiment, the aerosol generating device further includes an atomizer that is configured to generate the aerosol from the aerosol generating source of the aerosol delivering device to deliver the aerosol to the case.

Advantageous Effects of Invention

An aerosol delivering device and an aerosol generating device including the same according to embodiments of the present disclosure may be handled as one device in which a case accommodating an aerosol generating source and a rotation body accommodating a medium are integrated, thereby being easily carried and used.

In addition, chambers used for delivering an aerosol may be selected by rotating a rotation body, and thus, the medium can be replaced with a new medium without replacing the cartridge with a new cartridge.

In addition, chambers of a rotation body may include different types of medium, and thus, a user may freely enjoy aerosols having various flavors by selecting a desirable medium.

BEST MODE FOR CARRYING OUT THE INVENTION

Figure 1:
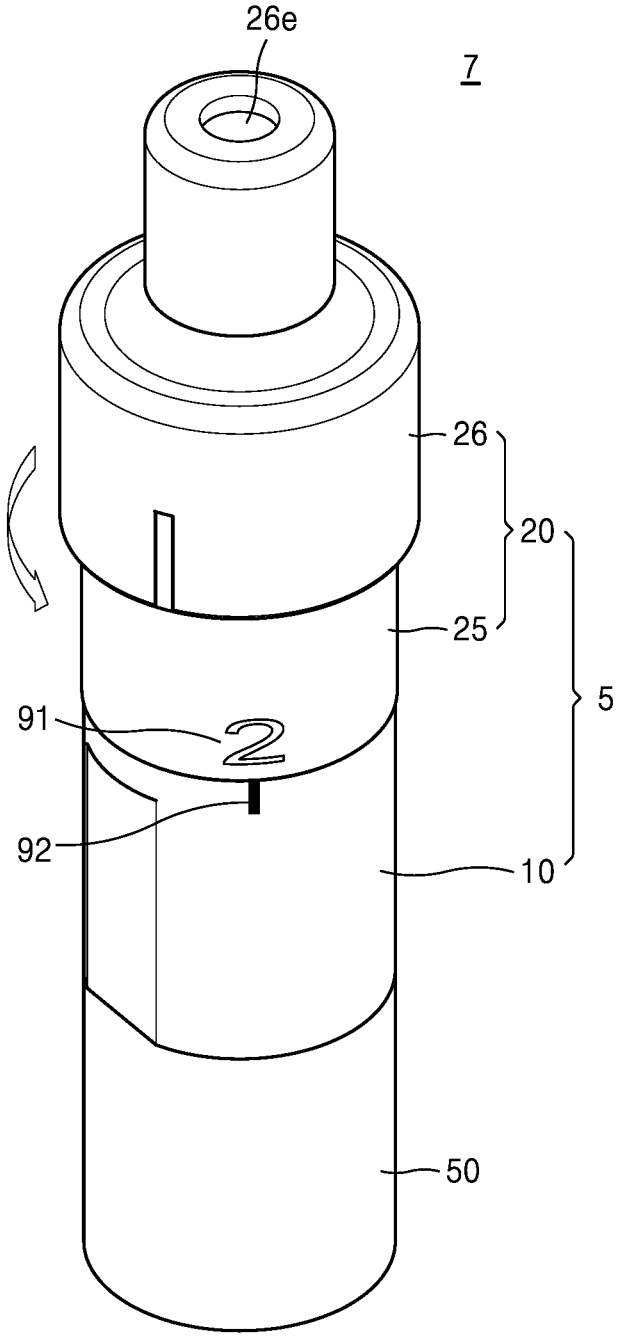
FIG. 1 is a perspective view of an aerosol delivering device and an aerosol generating device according to an embodiment.

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used to describe the various embodiments of the present disclosure should be defined based on the meanings of the terms and the descriptions provided herein.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element is referred to as being "over," "above," "on," "below," "under," "beneath," "connected to" or "coupled to" another element, it can be directly over, above, on, below, under, beneath, connected or coupled to the other element or intervening elements may be present. In contrast, when an element is referred to as being "directly over," "directly above," "directly on," "directly below," "directly under," "directly beneath," "directly connected to" or "directly coupled to" another element, there are no intervening elements present.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

In the present disclosure, while such terms as "first," "second," etc., may be used to describe various components, such components must not be limited to the above terms. The above terms are used only to distinguish one component from another.

Hereinafter, example embodiments of the present disclosure will now be described more fully with reference to the accompanying drawings, such that one of ordinary skill in the art may easily work the present disclosure. Embodiments of the disclosure may, however, be embodied in many different forms and should not be construed as being limited to the example embodiments set forth herein.

Hereinafter, an aerosol delivering device according to embodiments and a structure and effect of the aerosol delivering device will be described in detail with reference to the accompanying drawings.

FIG. 1 is a perspective view of an aerosol delivering device and an aerosol generating device according to an embodiment.

An aerosol generating device 7 according to an embodiment illustrated in FIG. 1 includes an aerosol delivering device 5 that delivers an aerosol to a user, and a lower case 50 connected to the aerosol delivering device 5.

The aerosol delivering device 5 includes a case 10 for accommodating an aerosol generating source for generating an aerosol, and a rotation body 20 arranged to rotate with respect to the case 10.

The case 10 of the aerosol delivering device 5 may be connected to the lower case 50 to perform a function of delivering an aerosol generated by an atomizer built in the lower case 50 to the rotation body 20.

The rotation body 20 includes a rotation case 25 including a medium for passing an aerosol therethrough, and a mouthpiece 26 including an outlet 26*e* for discharging an aerosol passing through the medium inside the rotation case 25 to the outside to deliver the aerosol to a user.

The rotation case 25 of the rotation body 20 includes a plurality of a mark 91 on an outer surface of the rotation case 25. The rotation body 20 includes a plurality of chambers therein, and each of the plurality of the mark 91 of the rotation case 25 is formed at a position corresponding to a respective one of the chambers.

The case 10 includes a reference mark 92 that may be used as a reference position for the mark 91 of the rotation case 25 on the outer surface of the case 10. Accordingly, by aligning the mark 91 of the rotation case 25 with the reference mark 92 of the case 10, a position of at least one of the chambers may be aligned with a position of a discharge hole of the case 10 for discharging an aerosol.

In addition, a user may obtain an information about the chamber through which an aerosol currently passes among the chambers of the rotation body 20 by checking a position of the mark 91 of the rotation case 25 and the reference mark 92 of the case 10.

Figure 2:
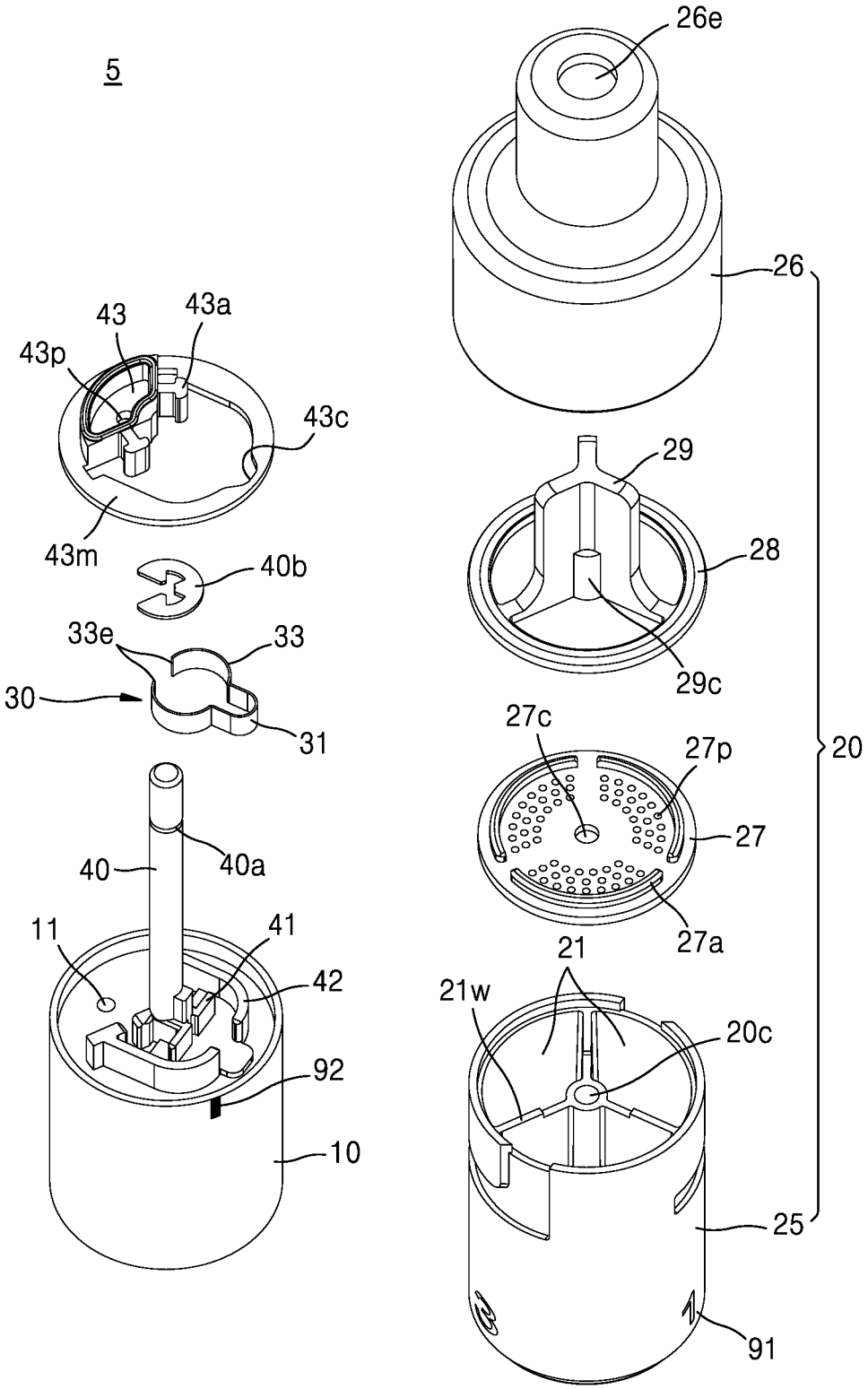
FIG. 2 is an exploded view schematically illustrating a coupling relationship between elements of the aerosol delivering device according to the embodiment illustrated in FIG. 1.
Figure 3:
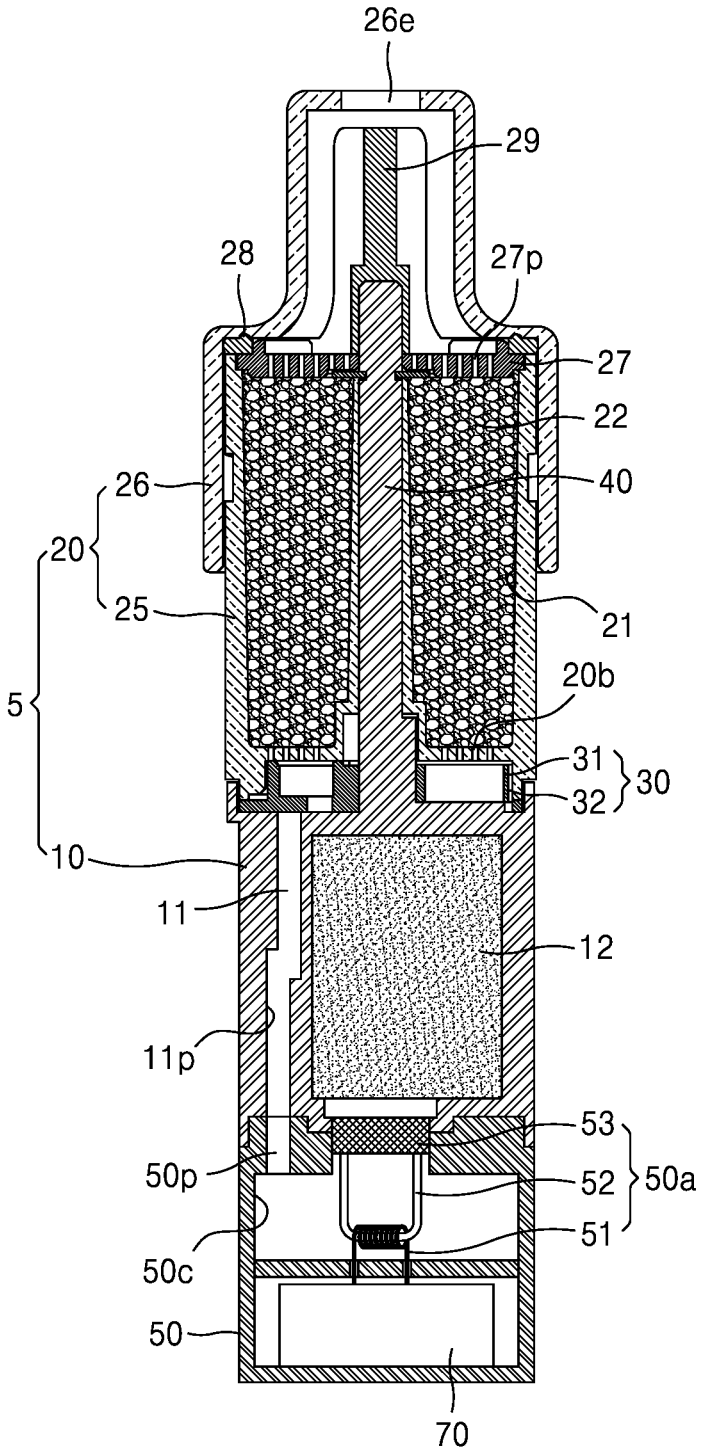
FIG. 3 is a longitudinal cross-sectional view of the aerosol generating device according to the embodiment illustrated in FIG. 1.

FIG. 2 is an exploded view schematically illustrating a coupling relationship between elements of the aerosol delivering device according to the embodiment illustrated in FIG. 1, and FIG. 3 is a longitudinal cross-sectional view of the aerosol generating device according to the embodiment illustrated in FIG. 1.

The aerosol delivering device 5 according to the embodiment illustrated in FIGS. 2 and 3 includes the case 10 that accommodates an aerosol generating source therein and includes a discharge hole 11 for discharging an aerosol generated from the aerosol generating source to the outside of the case 10, the rotation body 20 that is arranged to rotate with respect to the case 10 and includes a plurality of chambers 21 sequentially arranged in a rotation direction of the rotation body 20 and medium 22 which are accommodated in the respective chambers 21 to pass aerosols therethrough, and a position limiter 30 that maintains a rotational position of the rotation body 20 for the case 10 so that a position of at least one of the chambers 21 corresponds to a position of the discharge hole 11.

In the embodiments illustrated in FIGS. 1 to 3, the overall shapes of the aerosol delivering device 5 and the aerosol generating device 7 are cylindrical shapes. However embodiments of the present disclosure are not limited to the shapes of the aerosol delivering device 5 and the aerosol generating device 7. For example, a transverse cross-sectional shape of at least one of the case 10, the rotation body 20, and the lower case 50 may be changed to a polygon or an ellipse.

The case 10 accommodates an aerosol generating source 12 therein. The aerosol generating source 12 may be a material which is in, for example, a liquid state or a gel state. To be specific, the aerosol generating source 12 may be in a liquid state while contained inside the case 10, or may be in a state of being impregnated in a porous material such as sponge or cotton accommodated in the case 10.

The aerosol generating source 12 may be a liquid material and may include, for example, a tobacco-containing material including volatile tobacco flavor components or a non-tobacco material.

The aerosol generating source 12 may include, for example, water, a solvent, ethanol, a plant extract, a spice, a flavor agent, or a vitamin mixture.

The spice of the aerosol generating source 12 may include menthol, peppermint, spearmint oil, and various fruit flavor components, and is not limited thereto. The flavor agent may include components that may provide various flavors or savors to a user.

The vitamin mixture of the aerosol generating source 12 may be a mixture of at least one of vitamin A, vitamin B, vitamin C, and vitamin E, and is not limited thereto.

In addition, the aerosol generating source 12 may include an aerosol forming agent such as glycerin or propylene glycol.

An atomizer 50*a* that generates an aerosol by heating the aerosol generating source 12 of the case 10 and a power supply 70 are installed inside the lower case 50 connected to a lower portion of the case 10.

The power supply 70 may also include only a battery that supplies power to the atomizer 50*a* or may include a control chip, a control circuit board, or so on together with the battery for controlling power of the atomizer 50*a*.

The atomizer 50*a* includes a porous plate 53 that absorbs the aerosol generating source 12 from the case 10, a wick 52 that is connected to the porous plate 53 to absorb and hold the aerosol generating source 12, a heater 51 that is wound around the wick 52 or is in contact with the wick 52 or is arranged adjacent to the wick 52 to heat the aerosol generating source 12 to generate an aerosol, and an aerosol generating chamber 50*c* that surrounds the heater 51 to form an atmosphere for generating an aerosol.

The atomizer 50*a* performs a function of generating an aerosol by converting a phase of an aerosol generating material into a gaseous phase. The aerosol may refer to a gas in a state in which vaporized particles generated from an aerosol generating material is mixed with air.

The porous plate 53 may include a plate having fine pores through which a liquid passes, or a mesh material through which a liquid may pass.

The heater 51 may be an electrically resistive heating element that generates heat by using power supplied from the power supply 70.

Although the atomizer 50*a* illustrated in FIG. 3 includes an electrically resistive heating element, the embodiments are not limited by a configuration of the atomizer 50*a*. The atomizer 50*a* may also generate an aerosol by using, for example, an ultrasonic method or an induction heating method.

An aerosol generating chamber 50*c* is connected to a hole 50*p* for discharging an aerosol generated by the heater 51 to the outside of the lower case 50. Accordingly, an aerosol generated by the atomizer 50*a* is delivered to the case 10 through the hole 50*p* of the lower case 50.

The case 10 includes a passage 11*p* that extends in an extension direction of the case 10 and guides a flow of an aerosol. A lower end portion of the passage 11*p* is connected to the hole 50*p* of the lower case 50, and an upper end portion of the passage 11*p* is connected to the discharge hole 11 of the case 10. Accordingly, an aerosol delivered from the lower case 50 passes through the passage 11*p* of the case 10 and then is transferred to the rotation case 25 of the rotation body 20 through the discharge hole 11.

The rotation body 20 includes the rotation case 25, that is hollow and has a cylindrical shape, and the mouthpiece 26 that includes the outlet 26*e* for discharging an aerosol passing through the medium 22 accommodated in the rotation case 25 to the outside of the aerosol delivering device 5.

The medium 22 may be in a solid state and may include, for example, powder or a granule which is a collection of small-sized particles.

The medium 22 may include, for example, a tobacco-containing material containing volatile tobacco flavor components, an additive material such as a savor agent, a wetting agent, and/or organic acid, a flavored material such as menthol or a moisturizer, any one component of a plant extract, a spice, a flavor agent, and a vitamin mixture, or a mixture of the components.

The spice of the medium 22 may include menthol, peppermint, spearmint oil, and various fruit flavor components, and is not limited thereto.

The flavor agent of the medium 22 may include components capable of providing various flavors or savors to a user.

The vitamin mixture of the medium 22 may be a mixture of at least one of vitamin A, vitamin B, vitamin C, and vitamin E, and is not limited thereto.

The rotation case 25 includes a plurality of chambers 21 spaced apart from each other in sequence in a rotation direction of the rotation body 20. The chambers 21 are partitioned to be independent of each other by partition walls 21*w*. Inner end portions of the partition walls 21*w* meet at the center of the rotation case 25, and outer end portions of the partition walls 21*w* are connected to the inner walls of the rotation case 25.

In FIGS. 2 and 3, three of the chambers 21 are installed. However, embodiments of the present disclosure are not limited to the number of chambers 21, and the number of chambers 21 may be two, four, or more.

The rotation case 25 includes a long hole 20*c* extending in a longitudinal direction of the rotation case 25 at the center of a circumferential direction. A rotation shaft 40 installed to protrude toward an upper portion of the case 10 is inserted into the long hole 20*c*.

A lower end of the rotation shaft 40 is connected to the case 10. The rotation shaft 40 extends to protrude upward from the case 10, and the rotation shaft 40 is inserted into the long hole 20*c* of the rotation case 25. A lower end portion of the rotation shaft 40 is connected to the case 10, and when the case 10 is maintained in a fixed state, the rotation shaft 40 is also maintained to be fixed to the case 10, and thus, the rotation shaft 40 may rotatably support the case 25.

A groove 40*a* is formed in an outer surface of an upper end portion of the rotation shaft 40. When the long hole 20*c* of the rotation case 25 is coupled to the rotation shaft 40, the upper end portion of the rotation shaft 40 protrudes upward from the long hole 20*c*. When a washer 40*b* is fastened to the groove 40*a* of the rotation shaft 40, the rotation case 25 may only rotate around the rotation shaft 40, and a movement the rotation case 25 toward an extension direction of the rotation shaft 40 is limited.

When a user uses the aerosol generating device 7, if the user holds the case 10 with one hand and rotates the rotation body 20 with the other hand, the rotation body 20 rotates around the rotation shaft 40 with respect to the case 10.

The mouthpiece 26, including the outlet 26*e* for discharging an aerosol passing through the medium 22 of any one of the chambers 21 to the outside, is coupled to an upper portion of the rotation case 25. An upper plate 27 (e.g., a top plate) that covers upper end portions of the chambers 21 facing the outlet 26*e* is arranged on the rotation case 25. The upper plate 27 includes upper through holes 27*p* through which an aerosol passes, and a central through hole 27*c* through which an upper end portion of the rotation shaft 40 passes.

A sealing ring 28 is provided between an inner wall of the mouthpiece 26 and an outer edge of the upper plate 27. The upper plate 27 includes an upper flange 27*a* that protrudes from an upper surface thereof and extends in a circumferential direction. When the mouthpiece 26 is coupled to an upper portion of the rotation case 25 in a state in which the sealing ring 28 is coupled to the outside of the upper flange 27*a*, the sealing ring 28 is compressed between the upper flange 27*a* and an inner wall surface of the mouthpiece 26. The sealing ring 28 seals a space between the mouthpiece 26 and an outer edge of the rotation case 25, and thus, an aerosol passing through the medium 22 may be concentrated at the outlet 26*e* of the mouthpiece 26 without being dispersed toward an outside of the mouthpiece 26.

A flow guide 29 is coupled to an upper end portion of the rotation shaft 40 protruding from an upper surface of the upper plate 27. The flow guide 29 has a coupling hole 29*c* into which an upper end portion of the rotation shaft 40 is inserted, on a lower surface thereof.

The flow guide 29 is arranged inside the mouthpiece 26 and performs a function of guiding flow of an aerosol passing through the medium 22 of the chambers 21 to the outlet 26*e* of the mouthpiece 26. The flow guide 29 may include wings corresponding to the partition walls 21*w* defining the chambers 21, respectively.

The position limiter 30 for maintaining a rotational position of the rotation body 20 with respect to the case 10 is installed between the rotation body 20 and the case 10. The position limiter 30 may maintain the rotational position of the rotation body 20 with respect to the case 10 so that at least one of the chambers 21 of the rotation body 20 corresponds to a position of the discharge hole 11.

Figure 4:
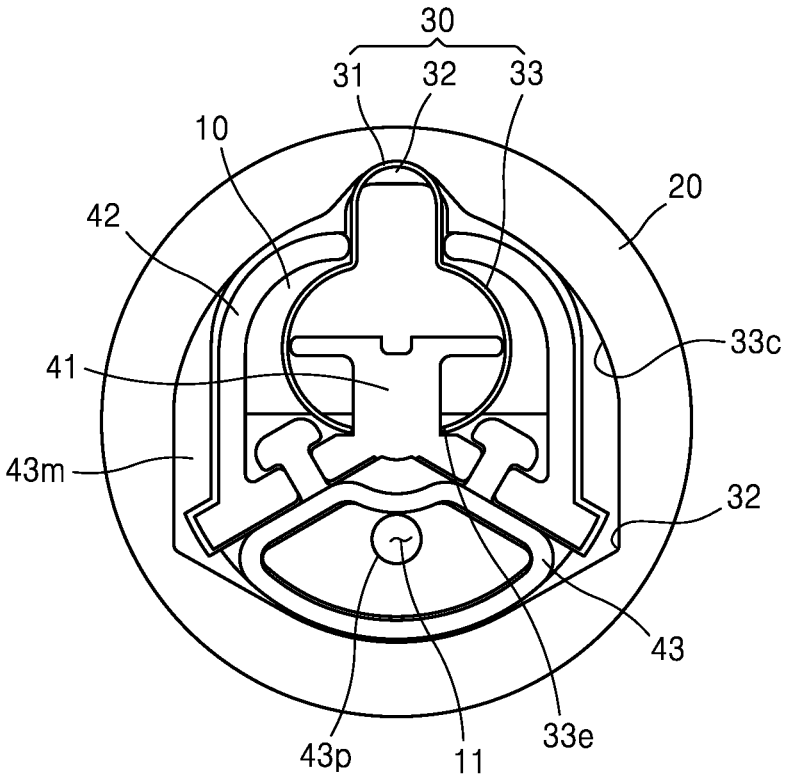
FIG. 4 is a transverse cross-sectional view of a portion of the aerosol generating device according to the embodiment illustrated in FIG. 1.

FIG. 4 is a transverse cross-sectional view of a portion of the aerosol generating device according to the embodiment illustrated in FIG. 1.

The position limiter 30 includes a protrusion 31 that is supported by any one of the rotation body 20 and the case 10. A plurality of grooves 32 are arranged on the other of the rotation body 20 and the case 10 and are coupled to the protrusion 31 to maintain a rotational position of the rotation body 20.

Referring to FIGS. 2 and 4, a spring 33 is installed between the rotation body 20 and the case 10. The spring 33 is made of an arc-shaped metal or a material such as rubber or plastic having elasticity, and includes an open end portion 33*e*. The protrusion 31 may be a part of the spring 33 and may be formed to protrude outward from the spring 33. The end portion 33*e* of the spring 33 is supported by an end support 41 arranged on the case 10, and at least a portion of an outside of the protrusion 31 of the spring 33 is supported by an outer support 42 arranged on the case 10.

The plurality of grooves 32 into which the protrusion 31 may be inserted are formed in an inner wall surface of the rotation body 20. The grooves 32 are formed to be spaced apart from each other in a circumferential direction around a rotation center of the rotation body 20. A cam surface 33*c* is provided between the grooves 32 to connect the grooves 32 and guide a movement of the protrusion 31.

When the rotation body 20 rotates with respect to the case 10, the protrusion 31 move along the cam surface 33*c*. When the protrusion 31 moves along the cam surface 33*c*, the protrusion 31 of the spring 33 is pressed by the cam surface 33*c*, thereby compressing the overall shape of the spring 33, while outer surfaces of the protrusion 31 is supported by the outer support 42 and the end portion 33*e* of the spring 33 is supported by the end support 41, and thus, the spring 33 does not drop out to the outside of the case 10 and may be held stably between the rotation body 20 and the case 10.

As illustrated in FIG. 4, when the protrusion 31 is coupled to any one of the grooves 32, the protrusion 31 is inserted into the one of the grooves 32, and thus, the overall shape of the compressed spring 33 returns to an original shape. In a state in which the protrusion 31 is coupled to any one of the grooves 32, the protrusion 31 exerts an elastic force toward the one of the grooves 32 in a state in which the end portion 33*e* of the spring 33 is supported by the end support 41, and thus, a rotational position of the rotation body 20 with respect to the case 10 may be maintained in a state illustrated in FIG. 4.

In the state illustrated in FIG. 4, when a user rotates the rotation body 20 with respect to the case 10, the protrusion 31 comes out of one of the grooves 32 and moves along the cam surface 33*c*, and then couples to adjacent another one of the grooves 32, and thus, the changed rotational position of the rotation body 20 with respect to the case 10 may be maintained.

Referring to FIG. 2, a transfer chamber 43 surrounding the discharge hole 11 is arranged between an upper portion of the case 10 and the rotation case 25 of the rotation body 20. The transfer chamber 43 includes a coupling protrusion 43*a* protruding from the transfer chamber 43 toward the outside, and by inserting the coupling protrusion 43*a* into the end support 41 arranged on the case 10, the transfer chamber 43 is stably coupled to the upper portion of the case 10.

The transfer chamber 43 includes a transfer hole 43*p* connected to the discharge hole 11, and thus, an aerosol discharged from the discharge hole 11 may be accommodated inside the transfer chamber 43 through the transfer hole 43*p*, and thereafter, the aerosol inside the transfer chamber 43 may be transferred to at least one of the chambers 21 of the rotation case 25. Therefore, the transfer chamber 43 performs functions of buffering a flow of aerosol between the case 10 and the rotation body 20 and transferring the aerosol to the rotation body 20.

The transfer chamber 43 may surround the discharge hole 11 to provide a space in which the aerosol may stay so that the aerosol forms appropriate pressure between the case 10 and the rotation body 20. Accordingly, the aerosol discharged from the discharge hole 11 of the case 10 enters the transfer chamber 43 to form appropriate pressure in the transfer chamber 43, is buffered, and is transferred to the chambers 21 of the rotation case 25, and thus, a flow of the aerosol from the case 10 toward the medium 22 of the chambers 21 of the rotation case 25 may be continuously and smoothly formed.

A lower sealing ring 43*m* that surrounds the transfer chamber 43 and extends in a circumferential direction along a coupling portion of the case 10 and the rotation case 25 is arranged between the case 10 and the rotation case 25. The lower sealing ring 43*m* includes a protrusion groove 43*c* of which an inner surface is partially recessed to provide a space in which the protrusion 31 of the spring 33 moves.

The lower sealing ring 43*m* and the transfer chamber 43 rotate together with the rotation case 25 in a state of being in close contact with a lower portion of the rotation case 25. As the lower sealing ring 43*m* performs a sealing function between the case 10 and the rotation case 25 while the rotation case 25 rotates, even when the rotation case 25 rotates repetitively with respect to the case 10, an internal space of the aerosol delivering device 5 may be safely sealed from the outside, and thus, an aerosol may be prevented from being rapidly cooled or a liquid in the aerosol delivering device 5 may be prevented from leaking to the outside.

Figure 5:
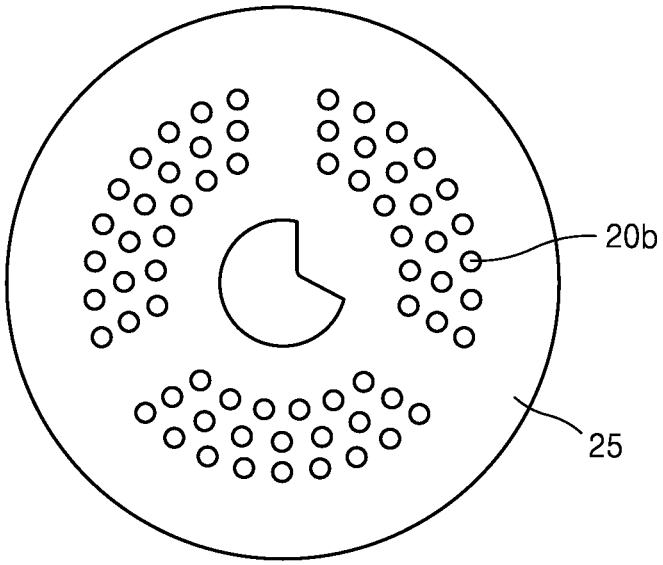
FIG. 5 is a transverse cross-sectional view of another portion of the aerosol generating device according to the embodiment illustrated in FIG. 1.

FIG. 5 is a transverse cross-sectional view of another portion of the aerosol generating device according to the embodiment illustrated in FIG. 1.

Referring to FIGS. 3 and 5, the rotation case 25 of the rotation body 20 includes lower through holes 20*b* through which an aerosol to be transferred via the discharge hole 11 of the case 10 and the transfer chamber 43 passes, at a lower surface of the rotation case 25. As the lower through holes 20*b* are connected to the chambers 21 of the rotation case 25, an aerosol enters the chambers 21 through the lower through holes 20*b* and then passes through the medium 22 accommodated in the chambers 21.

Figure 6:
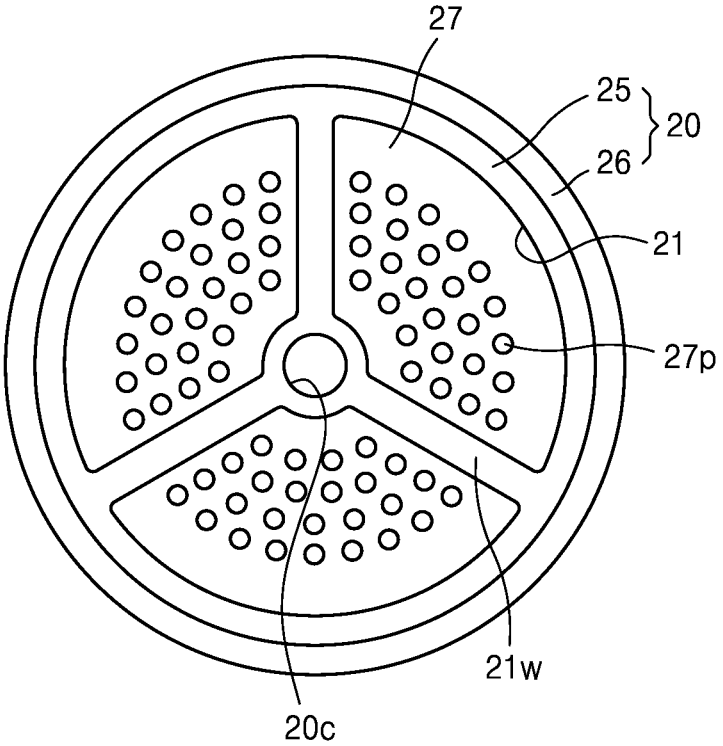
FIG. 6 is a cross-sectional view of yet another portion of the aerosol generating device according to the embodiment illustrated in FIG. 1.

FIG. 6 is a transverse cross-sectional view of another portion of the aerosol generating device according to the embodiment illustrated in FIG. 1.

An aerosol discharged from the case 10 and entering the chambers 21 of the rotation body 20 passes through the medium 22 accommodated in the chambers 21. The medium 22 adds flavor to the aerosol. The aerosol that passes through the medium 22 and contains rich flavor passes through the upper through holes 27*p* of the upper plate 27 arranged on the chambers 21 of the rotation case 25, and then is discharged to the outside of the aerosol delivering device 5 through the mouthpiece 26.

When using the aerosol delivering device 5 and the aerosol generating device 7 including the same described above, as a user rotates the rotation body 20 with respect to the case 10, a rotational position of the rotation body 20 is adjusted so that at least one of the chambers 21 of the rotation body 20 is placed at a position corresponding to the discharge hole 11 of the case 10.

In a state in which a position of at least one of the chambers 21 of the rotation body 20 corresponds to a position of the discharge hole 11 of the case 10, a user may inhale aerosol through the mouthpiece 26.

The aerosol delivering device 5 and the aerosol generating device 7 including the same may be handled as one device in which the case 10 accommodating the aerosol generating source 12 and the rotation body 20 accommodating the medium 22 are integrated, thereby being easily carried and used.

In addition, even if the case 10 of the aerosol delivering device 5 is designed to accommodate a large amount of an aerosol generating source 12, the chambers 21 used for delivering an aerosol may be selected by rotating the rotation body 20, and thus, medium 22 can be replaced with a new one of the medium 22 without replacing the cartridge with a new cartridge.

In addition, the chambers 21 of the rotation body 20 may include medium 22 of different types. For example, the chambers 21 may include a respect one of the medium 22 having particles of different sizes or different flavor properties. When the chambers 21 include different types of medium 22, a user may select one of the chambers 21 to select her/his favorite medium 22, thus freely enjoying aerosols having various types of flavor.

When the chambers 21 of the rotation body 20 include medium 22 having particles of different sizes, a size of at least one of the upper through holes 27*p*, through which an aerosol of the upper plate 27 passes, and the lower through holes 20*b*, that are formed in a lower surface of the rotation case 25 and passes an aerosol therethrough, may be adjusted to correspond to the sizes of the particles of the medium 22. That is, as sizes of particles of the medium 22 included in the chambers 21 are different from each other between the chambers 21, diameters of the lower through holes 20*b* corresponding to each of the chambers 21 may be designed to be smaller than sizes of particles of the medium 22, and considering an increase in breath resistance due to the sizes of the particles of the medium 22, diameters of the upper through holes 27*p* corresponding to each of the chambers 21 may also be increased according to the sizes of the particles of the medium 22.

MODE FOR THE INVENTION

Figure 7:
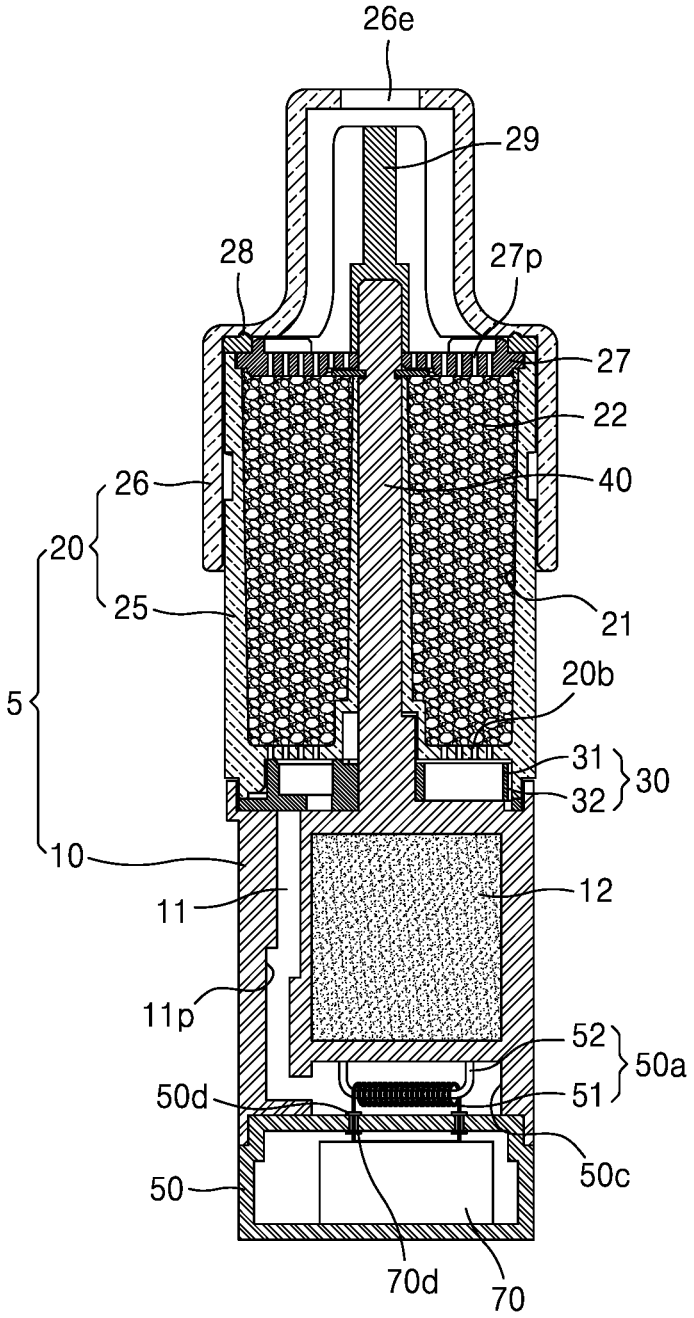
FIG. 7 is a longitudinal cross-sectional view of an aerosol generating device according to another embodiment.

FIG. 7 is a longitudinal cross-sectional view of an aerosol generating device according to another embodiment.

A configuration of the aerosol generating device according to the embodiment illustrated in FIG. 7 is similar to the configuration of the aerosol generating device 7 according to the embodiments illustrated in FIGS. 1 and 6 as a whole, and a position at which the atomizer 50*a* is installed is modified.

The atomizer 50*a* includes the aerosol generating chamber 50*c* formed under the rotation case 25, the wick 52 arranged in the aerosol generating chamber 50*c* to absorb and hold the aerosol generating source 12 from the rotation case 25, and the heater 51 that heats the wick 52 to generate an aerosol.

The aerosol generating chamber 50*c* is connected to the passage 11*p* for guiding flow of an aerosol generated by the heater 51. An upper end portion of the passage 11*p* is connected to the discharge hole 11 of the case 10. Accordingly, an aerosol generated by the atomizer 50*a* passes through the passage 11*p* of the case 10 and then is transferred to the rotation case 25 of the rotation body 20 through the discharge hole 11.

The power supply 70 that supplies power to the atomizer 50*a* is installed inside the lower case 50 connected to a lower portion of the case 10. The power supply 70 may also include only a battery that supplies power to the atomizer 50*a* or may include a control chip or a control circuit board together with the battery for controlling power of the atomizer 50*a*. A heater terminal 50*d* of the heater 51 of the atomizer 50*a* is electrically connected to an electric terminal 70*d* of the power supply 70, and thus, the power supply 70 supplies power to the heater 51.

Figure 8:
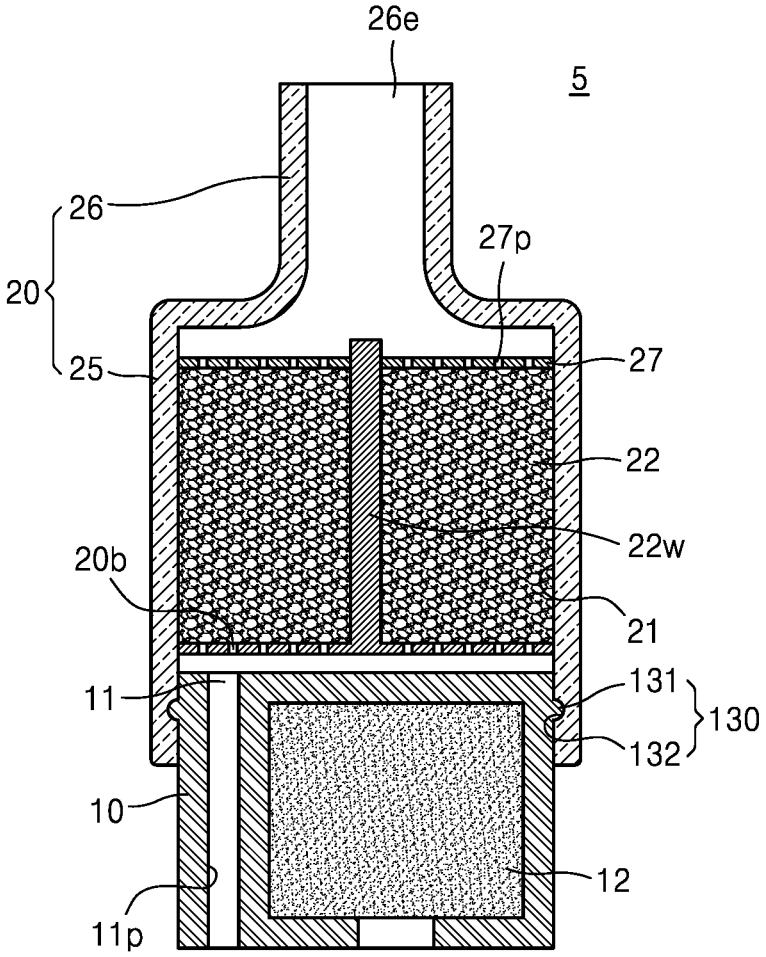
FIG. 8 is a longitudinal cross-sectional view of an aerosol delivering device according to another embodiment.

FIG. 8 is a longitudinal cross-sectional view of the aerosol delivering device according to another embodiment.

The aerosol delivering device 5 according to the embodiment illustrated in FIG. 8 includes the case 10 that accommodates an aerosol generating source 12 for generating an aerosol, and the rotation body 20 arranged to rotate with respect to the case 10.

The rotation body 20 includes the rotation case 25 including the medium 22 through which an aerosol passes, and the mouthpiece 26 including the outlet 26*e* for discharging an aerosol passing through the medium 22 in the rotation case 25 to the outside.

The case 10 accommodates the aerosol generating source 12 therein and includes the passage 11*p* for transferring an aerosol generated by the aerosol generating source 12 and the discharge hole 11 for discharging an aerosol passing through the passage 11*p* to the outside of the case 10 to be transferred to the rotation body 20.

An atomizer may also be installed in a lower case coupled to the case 10 as in the embodiment illustrated in FIGS. 1 to 6, or the atomizer may also be installed in the case 10 as in the embodiment illustrated in FIG. 7.

The rotation body 20 is arranged to rotate with respect to the case 10 and includes the plurality of chambers 21 sequentially arranged in a rotation direction and the medium 22 that are accommodated in the respective chambers 21 to pass an aerosol therethrough. The chambers 21 are partitioned independently of each other by the partition walls 22*w*.

Unlike the embodiments illustrated in FIGS. 1 to 7, the aerosol delivering device 5 according to the embodiment illustrated in FIG. 8 does not include a rotation shaft that supports the rotation body 20. The rotation body 20 and the case 10 each have a cylindrical shape, and a rotation guide 130 that guides a rotation of the rotation body 20 with respect to the case 10 is installed between the rotation body 20 and the case 10.

The rotation guide 130 includes a rail 131 that protrudes from an outer surface of the case 10 and extends in a circumferential direction of the case 10, and a circumferential groove 132 that extends in a circumferential direction of the rotation body 20 on an inner surface of the rotation body 20 and accommodates the rail 131 to support the rail 131 while the rotation body 20 rotates.

The embodiments of the present disclosure are not limited by the configuration of the rotation guide 130 illustrated in FIG. 8, and for example, the circumferential groove 132 may also be installed in the case 10 and the rail 131 may also be installed in the rotation body 20, and a bearing may be additionally installed between the rotation body 20 and the case 10.

The rotation body 20 includes the rotation case 25 including the chambers 21 that accommodate the medium 22 through which an aerosol passes, and further includes the mouthpiece 26 that is formed integrally with the rotation case 25 and includes the outlet 26*e* for discharging an aerosol passing through the medium 22 to the outside.

Figure 9:
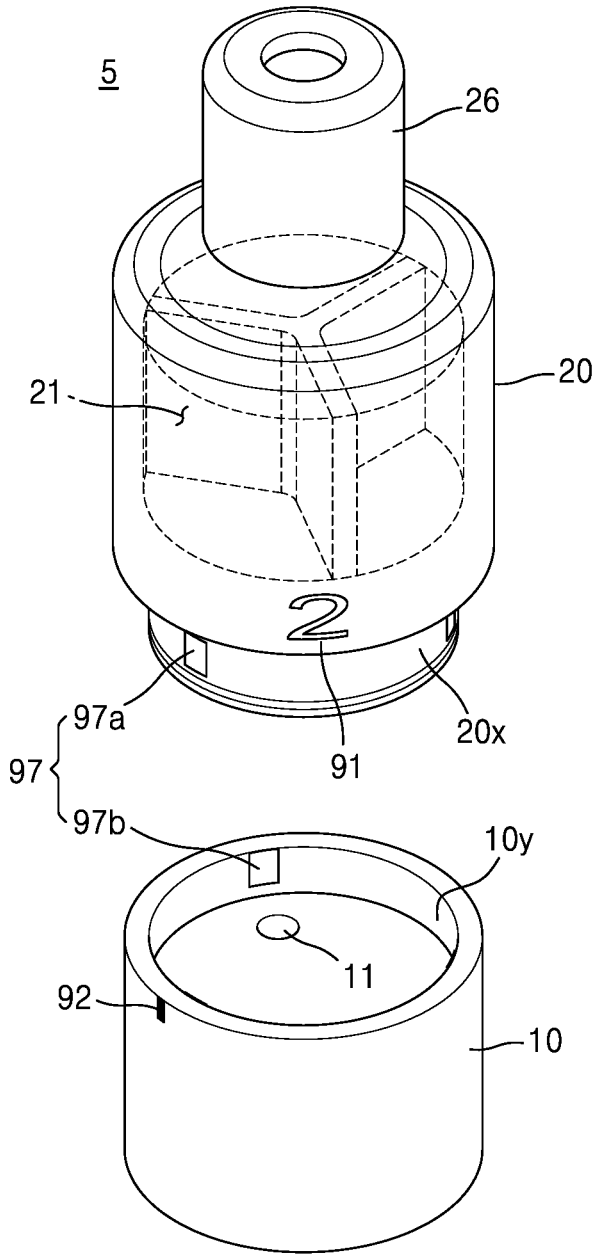
FIG. 9 is an exploded view schematically illustrating a coupling relationship between some elements of an aerosol delivering device according to another embodiment.

FIG. 9 is an exploded view schematically illustrating a coupling relationship between some elements of an aerosol delivering device according to another embodiment.

The aerosol delivering device 5 according to the embodiment illustrated in FIG. 9 includes the case 10 that accommodates an aerosol generating source for generating an aerosol and includes the discharge hole 11 for discharging an aerosol, and the rotation body 20 that is arranged to rotate with respect to the case 10 and includes the plurality of chambers 21 capable of accommodating medium.

In FIG. 9, an element such as a rotation shaft or a rotation guide that rotatably connects the rotation body 20 to the case 10 is omitted, but the element such as the rotation shaft or the rotation guide included in the embodiments illustrated in FIGS. 1 to 8 may be applied to the aerosol delivering device 5 according to the embodiment illustrated in FIG. 9.

The rotation body 20 includes the mark 91 on an outer surface thereof. The case 10 includes the reference mark 92 that may be used as a reference position for the mark 91 of the rotation case 25 on the outer surface of the case 10. The rotation body 20 includes the plurality of chambers 21 therein, and the mark 91 of the rotation body 20 is formed at a position corresponding to each of the chambers. Accordingly, by aligning the mark 91 of the rotation body 20 with the reference mark 92 of the case 10, a position of at least one of the chambers 21 may be aligned with a position of the discharge hole 11 of the case 10.

In addition, a user may obtain an information about the chamber through which an aerosol currently passes among the chambers 21 of the rotation body 20 by checking a position of the mark 91 of the rotation body 20 and the reference mark 92 of the case 10.

The rotation body 20 includes a coupling flange 20*x* protruding from a lower portion of the rotation body 20, and as the coupling flange 20*x* is inserted into an accommodation flange 10*y* on the case 10, the rotation body 20 and the case 10 are coupled to each other.

A signal generator 97 is installed between the rotation body 20 and the case 10. The signal generator 97 indicates the type of a medium included in a chamber through which an aerosol currently passes among the chambers 21 according to a rotational position of the rotation body 20.

The signal generator 97 includes a transmitter 97*a* arranged on the coupling flange 20*x* of the rotation body 20, and a receiver 97*b* arranged on the accommodation flange 10*y* of the case 10 to detect the transmitter 97*a*. The embodiments of the present disclosure are not limited by an arrangement position or the numbers of the transmitter 97*a* and the receiver 97*b*, and for example, the transmitter 97*a* may also be arranged on the case 10 and the receiver 97*b* may also be arranged on the rotation body 20.

The transmitter 97*a* and the receiver 97*h* of the signal generator 97 may be implemented by one of, for example, an optical sensor such as a photo coupler, a magnetic sensor for detecting a magnetic force by using Hall effect, an electrical resistance sensor for detecting a change in electrical resistance, and so on, or a combination thereof.

Figure 10:
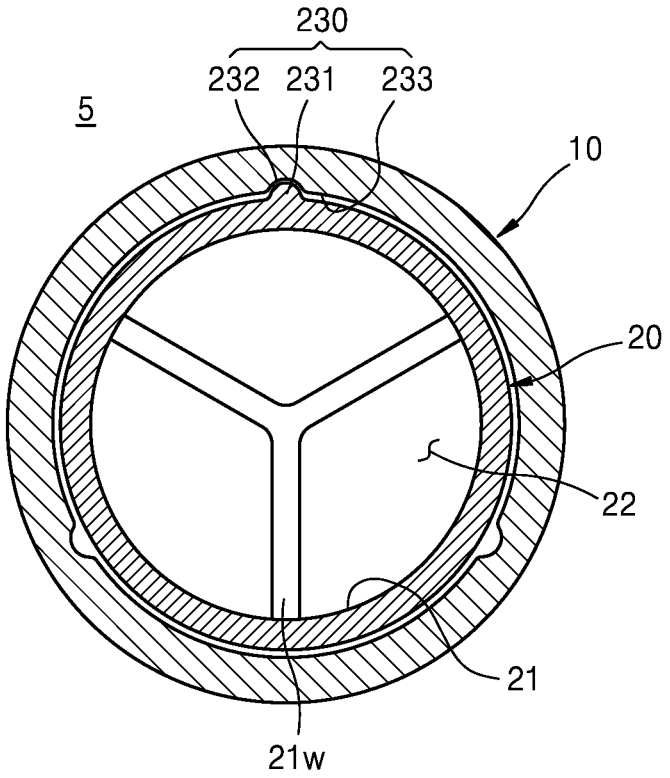
FIG. 10 is a transverse cross-sectional view of a portion of an aerosol delivering device according to another embodiment.

FIG. 10 is a transverse cross-sectional view of a portion of an aerosol delivering device according to another embodiment.

The aerosol delivering device 5 according to the embodiment illustrated in FIG. 10 includes the case 10 that accommodates an aerosol generating source for generating an aerosol and includes a discharge hole for discharging the aerosol, and the rotation body 20 that is arranged to rotate with respect to the case 10 and includes the plurality of chambers 21 partitioned by the partition walls 21*w* to accommodate the medium 22.

The aerosol delivering device 5 includes a position limiter 230 that is arranged between the case 10 and the rotation body 20 and maintains a rotational position of the rotation body 20 with respect to the case 10 so that a position of at least one of the chambers 21 corresponds to a position of a discharge hole of the case 10.

The position limiter 230 includes a positioning protrusion 231 that protrudes from an outer surface of the rotation body 20, and a positioning groove 232 that is formed to be recessed in an inner surface of the case 10 to accommodate the positioning protrusion 231.

The embodiments of the present disclosure are not limited by a configuration of the position limiter 230, and for example, the positioning protrusion 231 may also be installed on an inner wall of the case 10 and the positioning groove 232 may also be installed on an outer wall of the rotation body 20, and the position limiter 230 may also include an additional element such as a spring installed between the case 10 and the rotation body 20.

In addition, similar to the embodiment illustrated in FIG. 4, a cam surface for guiding a movement of the positioning protrusion 231 may also be installed on an inner wall surface 233 of the case 10 connected to the positioning groove 232 adjacent thereto.

Figure 11:
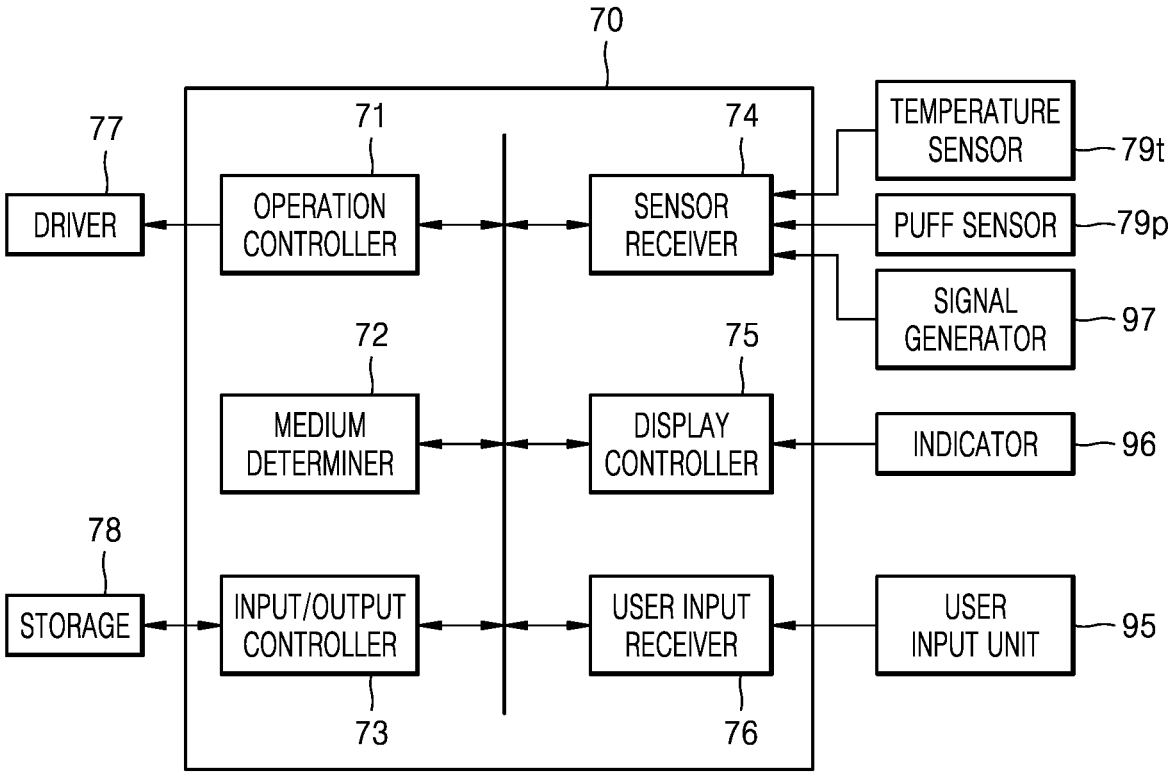
FIG. 11 is a block diagram schematically illustrating a connection relationship between a power supply applicable to an aerosol generating device including an aerosol delivering device according to the embodiments illustrated in FIGS. 1 to 10 and other configuration elements.

FIG. 11 is a block diagram schematically illustrating a connection relationship between a power supply and other elements applicable to the aerosol generating device including the aerosol delivering device according to the embodiments illustrated in FIGS. 1 to 10.

A power supply 70 illustrated in FIG. 11 may be implemented by any one of a circuit board arranged inside the lower case 50 illustrated in FIG. 1, a semiconductor chip attached to the circuit board, or software installed in the semiconductor chip or the circuit board, or a combination thereof.

The power supply 70 includes an operation controller 71 that controls the amount or a temperature of an aerosol by controlling a driver 77 for driving an atomizer, a sensor receiver 74, a display controller 75 that controls an indicator 96 which provides information to a user, a user input receiver 76 that receives a user input signal from a user input unit 95 such as a button, a touch screen, or a switch that detects an input operation of a user, an input/output controller 73 that transmits and receives data, and a medium determiner 72 that determines the type of medium (e.g., medium 22) which is currently used based on a signal received from a signal generator 97.

The sensor receiver 74 may be configured receive a signal from a temperature sensor 79*t* of the aerosol delivery device 5 that detects a temperature associated with an atomizer (e.g., atomizer 50*a*), a puff sensor 79*p* of the aerosol delivery device 5 that detects a change in pressure or speed of air generated when a user inhales an aerosol, and a rotational position detection sensor (e.g., the signal generator 97 illustrated in FIG. 8) of the aerosol delivery device 5 for detecting a rotational position of a rotation body (e.g., rotation body 20) with respect to a case (e.g., case 10).

The aerosol delivery device 5 may also include a storage 78 including information on the type of medium, a temperature profile for controlling an operation temperature of an atomizer, information on a user, or so on. The storage 78 may be included in or with the power supply 70. According to embodiments, the power supply 70 may be referred to as a controller and may include at least one processor configured to perform the functions of the power supply 70.

When an aerosol generating device includes the power supply 70 described above, power of an atomizer (e.g., atomizer 50*a*) may start or may stop by detecting an inhalation motion of a user. In addition, the power supply 70 may determine the type of medium currently used based on a signal applied from the signal generator 97 and control an operation temperature, an operation time, or so on of an atomizer so as to be appropriate to the type of medium.

Figure 12:
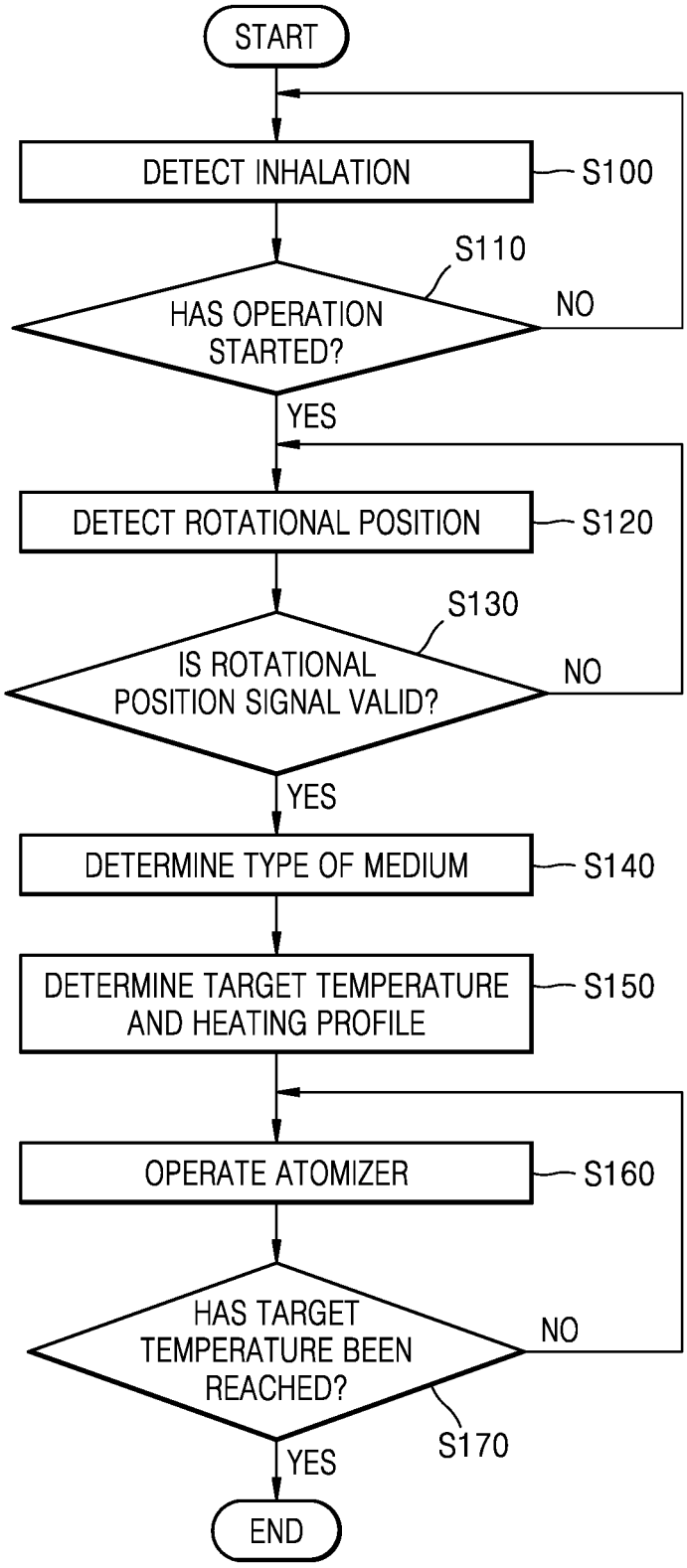
FIG. 12 is a flowchart schematically illustrating a method of delivering an aerosol by an aerosol delivering device according to the embodiments illustrated in FIGS. 1 to 11.

FIG. 12 is a flowchart schematically illustrating an aerosol delivering method of an aerosol delivering device according to the embodiments illustrated in FIGS. 1 to 11.

An aerosol delivering method according to the embodiment illustrated in FIG. 12 includes a step of detecting an inhalation operation of a user S100, a step of starting an aerosol delivery operation by determining that the inhalation operation is detected S110, a step of detecting a rotational position of a rotation body with respect to a case S120, a step of determining whether or not a signal of the detected rotational position of the rotation body is valid S130, a step of determining the type of medium that is currently used for delivering of an aerosol based on the signal of the rotational position of the rotation body S140, a step of determining at least one of a target temperature for power of an atomizer and a heating profile for controlling a heating operation of the atomizer based on the determined type of medium S150, a step of operating the atomizer based on the target temperature or the heating profile S160, a step of detecting a current temperature to compare with the target temperature S170, and a step of ending the operation of the atomizer when the target temperature is reached.

According to the aerosol delivering method described above, the type of medium currently used for delivering an aerosol may be determined by detecting a rotational position of a rotation body with respect to a case, and thus, operations of an atomizer may be controlled to be appropriate to the medium currently used. Accordingly, a user may enjoy aerosols having various flavor properties by freely selecting a medium.

Those of ordinary skill in the art related to embodiments of the present disclosure may understand that various changes in form and details can be made therein without departing from the scope of the characteristics described above. The disclosed methods should be considered in a descriptive sense only and not for purposes of limitation.

INDUSTRIAL APPLICABILITY

Embodiments of the present disclosure relate to an aerosol delivering device that is convenient to carry and use because chambers including medium rotate, and an aerosol generating device including the same.

The invention claimed is:

1. An aerosol delivering device comprising:

a case that is configured to accommodate an aerosol generating source and includes a discharge hole that is configured to discharge an aerosol generated by the aerosol generating source;

a rotation body that is configured to rotate with respect to the case, includes a plurality of chambers sequentially arranged in a rotation direction, each of the plurality of chambers accommodating a medium including a granule in a solid state such that the aerosol discharged from the discharge hole passes through the medium;

a position limiter that is configured to maintain a rotational position of the rotation body with respect to the case so that a position of at least one of the plurality of chambers corresponds to a position of the discharge hole; and a transfer chamber arranged between the rotation body and the case and comprising a first surface surrounding the discharge hole, a transfer hole on the first surface aligned with the discharge hole, and walls extending from the first surface towards the rotation body forming a space, and is configured to transfer the aerosol discharged from the discharge hole through the transfer hole into the space and then to at least one of the plurality of chambers by buffering a flow of the aerosol such that the aerosol forms pressure inside the space between the rotation body and the case, wherein the rotation body further comprises:

an upper plate that covers end portions of the plurality of chambers, and includes a plurality of upper through holes through which the aerosol, which passed through the medium of the plurality of chambers, is discharged out of the plurality of chambers; and a plurality of lower through holes that are configured to transfer the aerosol delivered from the discharge hole to at least one of the plurality of chambers.

2. The aerosol delivering device of claim 1, wherein the position limiter includes a protrusion supported by one from among the rotation body and the case, and a plurality of grooves arranged in the other from among the rotation body and the case, the plurality of grooves configured to couple to the protrusion to maintain the rotational position of the rotation body.

3. The aerosol delivering device of claim 2, wherein the other from among the rotation body and the case further comprises a cam surface formed between the plurality of grooves, the cam surface configured to guide a movement of the protrusion.

4. The aerosol delivering device of claim 2, wherein the position limiter further includes a spring that is arranged between the rotation body and the case, and is configured to be pressed between the rotation body and the case while the rotation body rotates such as to be deformed elastically, wherein the protrusion is a part of the spring.

5. The aerosol delivering device of claim 4, wherein the spring has an arc shape, and the aerosol delivering device further comprises:

an end support portion that is configured to support an end portion of the spring, and an outer support portion that is configured to support at least a part of an outer side of the spring.

6. The aerosol delivering device of claim 1, further comprising:

a rotation shaft that is connected to the case and rotatably supports the rotation body.

7. The aerosol delivering device of claim 1, wherein the rotation body further comprises:

a mouthpiece that includes an outlet configured to discharge the aerosol passing through the medium accommodated in the plurality of chambers to the outside.

8. The aerosol delivering device of claim 1, further comprising:

a sealing ring arranged between the mouthpiece and an edge of the upper plate.

9. The aerosol delivering device of claim 1, wherein the plurality of upper through holes forms a plurality of groups of upper through holes, and each of the plurality of groups of upper through holes corresponds to each of the plurality of chambers.

10. The aerosol delivering device of claim 1, wherein the plurality of lower through holes forms a plurality of groups of lower through holes, and each of the plurality of groups of lower through holes corresponds to each of the plurality of chambers.

11. The aerosol delivering device of claim 1, further comprising:

a rotation guide arranged between the case and the rotation body and configured to guide a rotation operation of the rotation body, wherein the case and the rotation body have a cylindrical shape.

12. The aerosol delivering device of claim 1, wherein the medium of each of the plurality of chambers of the rotation body are different types from each other.

13. The aerosol delivering device of claim 12, wherein the rotation body further comprises a plurality of marks that indicate the types of the medium included in the plurality of chambers and are arranged to correspond to each of the plurality of chambers.

14. The aerosol delivering device of claim 12, further comprising:

a signal generator that is arranged between the rotation body and the case and is configured to indicate a type of the medium of one of the plurality of chambers through which the aerosol passes among the plurality of chambers according to the rotational position of the rotation body.

15. An aerosol generating device including the aerosol delivering device of claim 1, further comprising:

an atomizer that is configured to generate the aerosol from the aerosol generating source of the aerosol delivering device to deliver the aerosol to the case.

* * * * *